United States Patent [19]

Carlson

[11] 3,974,836

[45] Aug. 17, 1976

[54] GIRDLE

[76] Inventor: Aileen S. Carlson, 8536 Mansfield, Morton Grove, Ill. 60053

[22] Filed: Apr. 14, 1975

[21] Appl. No.: 567,700

[52] U.S. Cl. ..... 128/526

[51] Int. Cl.[2] ..... A41C 1/00

[58] Field of Search ..... 128/526–530, 128/546, 547

[56] References Cited

UNITED STATES PATENTS

| | | | |
|---|---|---|---|
| 2,617,101 | 11/1952 | Weintraub | 128/526 |
| 2,661,002 | 12/1953 | Silverman | 128/526 |
| 3,140,718 | 7/1964 | Farkas | 128/527 |
| 3,279,469 | 10/1966 | Schustack | 128/526 |
| 3,327,707 | 6/1967 | Storti | 128/546 X |
| 3,441,027 | 4/1969 | Lehman | 128/547 X |
| 3,515,142 | 6/1970 | Black | 128/546 X |
| 3,746,009 | 7/1973 | Cuozzi | 128/529 |
| 3,835,866 | 9/1974 | Brooks | 128/547 |

FOREIGN PATENTS OR APPLICATIONS

| | | | |
|---|---|---|---|
| 1,933,947 | 1/1971 | Germany | 128/526 |

*Primary Examiner*—G. V. Larkin

*Attorney, Agent, or Firm*—Watson D. Harbaugh

[57] ABSTRACT

A girdle having an extra length crotch opening covered by a two-way stretch extendable brief crotch closure panel having the top of the back portion secured at approximately the waist opening of the girdle, the sides secured laterally along the girdle side seams above the leg portions and terminating in front in a short crotch flap portion which in coaction with the stretchability of the back portion can be extended forwardly over and around the crotch of the wearer to rest marginally on the pelvis and terminate in a widened end that preferably is stretched laterally and secured in front on the girdle at approximately the pelvic crest.

5 Claims, 5 Drawing Figures

FIG. 5
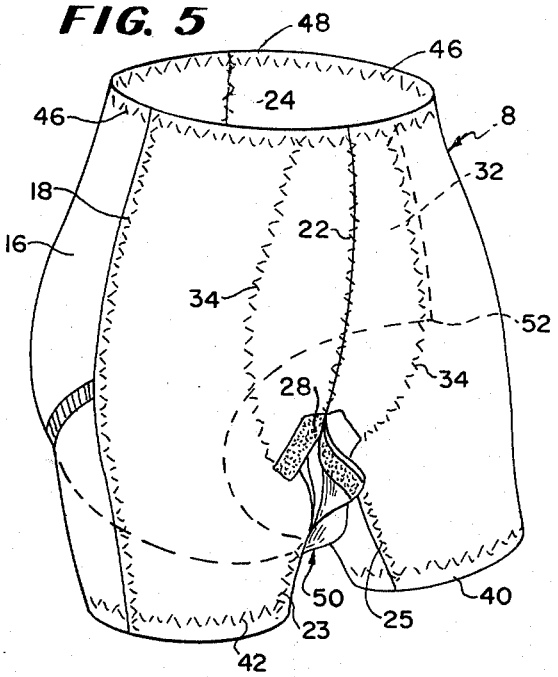
FIG. 6
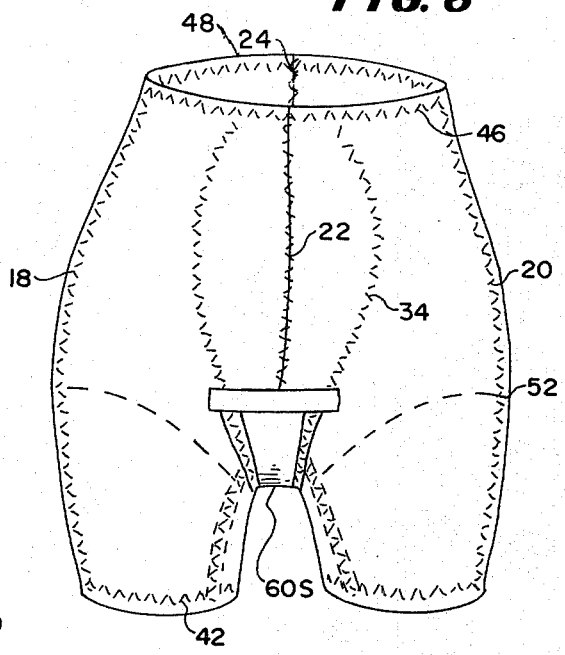
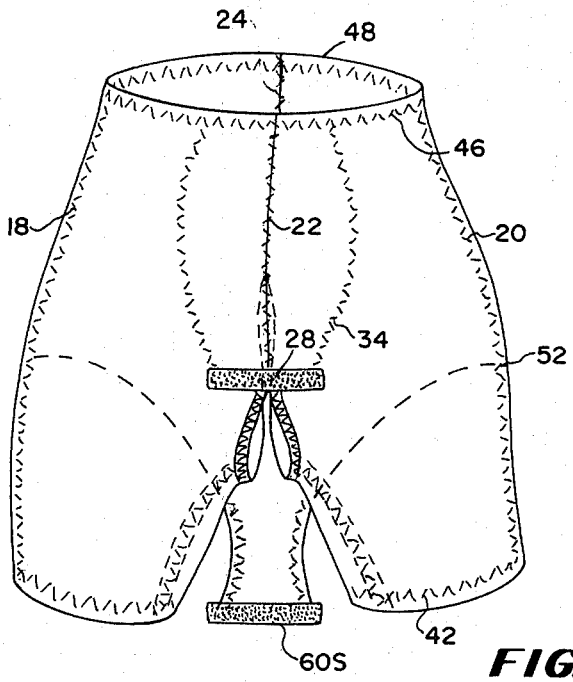
FIG. 7

GIRDLE

BACKGROUND OF INVENTION

A girdle being quite personal to the wearer, whether it be a panty, high-rise, or all-in-one girdle, it is important that it serve two basic purposes; one, to well shape the wearer's torso front and back, support the abdomen, improve the appearance of the wearer and do so with comfort; and, two, to provide excellent sanitation and cleanliness under easily controlled conditions, with minimum worry, inconvenience and effort to the wearer. More particularly, it should be easily manipulated to accommodate bathroom necessities of the wearer without being soiled and without requiring dislodgement or removal of either the girdle or other clothing.

Crotch opening provided in girdles heretofore have been narrow with objectionable soiling and are limited in length to prevent objectionable irregularities in the appearance of the outer garment in front and in back. Conventional displaceable crotch straps used to cover such openings are too long in front to be safely clear from being soiled in use unless completely removed. This is seldom done. Soiling is disconcerting when discovered and after the first few experiences the panty girdle will probably be removed each time toiletwise regardless of whether the crotch strap is removed or displaceable in whole or in part. Moreover, whether a detachable crotch strap is being removed or not during use it is not generally detached when laundering but rather the whole panty girdle, even though otherwise relatively clean, is laundered by the wearer. If removed it is often misplaced or lost.

SUMMARY OF INVENTION

In the present invention the crotch opening is quite long particularly at the back and is closed by a two-way stretch crotch flap on a two-way stretch panel whose back portion is marginally secured at the waist level of the wearer and laterally along a substantial length of the side seams of the main body of the girdle thereby providing a multiple thickness elastic support over the wearer's fanny that is externally smooth for dress appearances when stretched and provides a firm shaping of any outer garment. The crotch opening is easily covered by drawing the crotch flap downwardly, forwardly and laterally stretching the free end of the flap and terminally securing it to the main body at approximately the public crest of the wearer. The length of the stretch area and the elasticity in the panel for supporting the crotch flap is quite extensive and draws the crotch flap to the rear to clear the crotch opening fully when free to do so. However, the free end of the crotch flap though displaced rearwardly a substantial distance horizontally when not stretched is still readily accessible for manual retrival from the front between the legs for a downward forward stretch and a refastening in the front. After stretching and fastening, any stretch or tension initially concentrated in the crotch flap is quickly distributed back through the back panel to waistlevel of the wearer and the side seams over the back and hip portions of the wearer with an end result that a comfortable snugness and firm support is provided over the crotch area. The lightness of the tension thus established over this expanse permits the crotch flap to move with the limited natural movement of the wearer's skin without lateral strain, slipping, or chafing Although the invention is illustrated essentially with a panty girdle that can be removed, the full free crotch control of the present invention will be further appreciated for a high-rise or all-in-one brassiere girdle both of which are not easily removed. Moreover, the lateral tension effective from the side seams and the wide lateral stretch engagement in the front provide a substantial influence in prevent wadding of the flap portion in the crotch while locating its edges in the fold lines of the wearer's skin around the upper leg contours. IN

IN THE DRAWINGS

FIG. 5 is a quartering front perspective view of the panty girdle shown in FIG. 2 with the crotch flap restretched and partially refastened.

FIGS. 6 and 7 are views similar to FIGS. 1 and 2 showing a modification of the crotch flap refastening means.

DESCRIPTION OF PREFERRED EMBODIMENT

Figure 1:
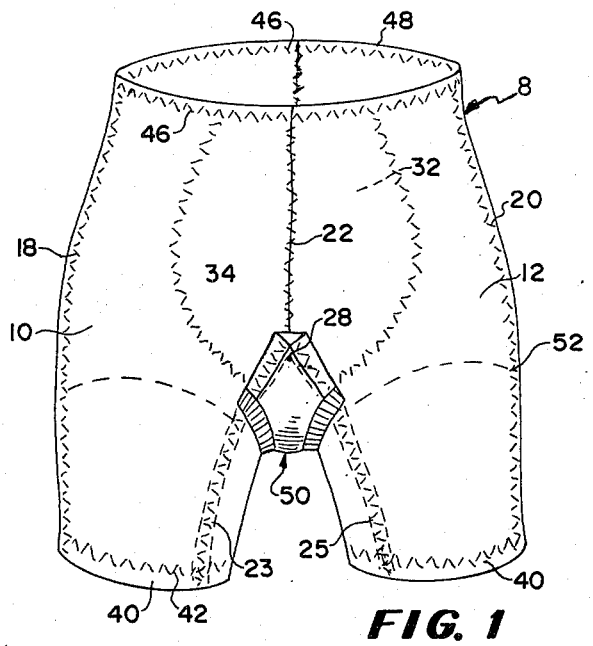
FIG. 1 is a front perspective view of a panty girdle embodying the invention as it appears on a wearer.
Figure 2:
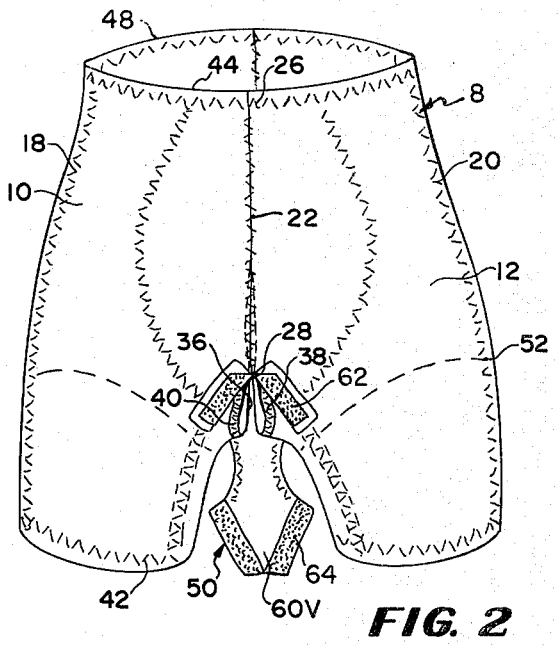
FIG. 2 is the same view as FIG. 1 but with the crotch flap fastener released.
Figure 3:
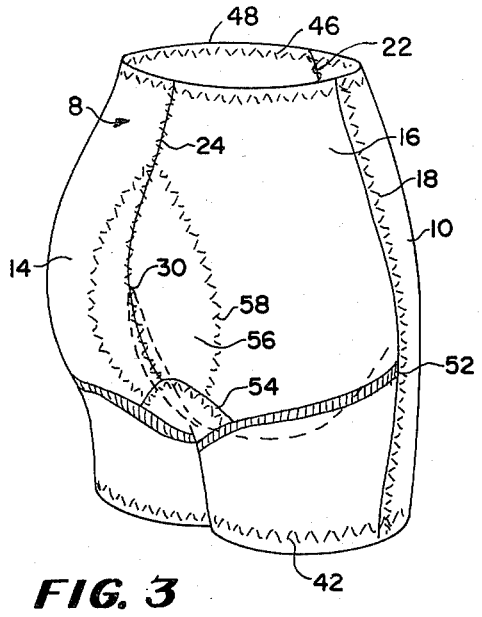
FIG. 3 is a quartering rear perspective view of the embodiment shown in FIG. 1.

Referring now to the drawings in further detail a panty girdle is illustrated in FIGS. 1, 2, and 3 having a trunk 8 in which four quarter panels 10, 12, 14 and 16 of two-directional stretch material cut to a pattern for shape are provided in which each lateral pair (10, 16 and 12, 14) are stitched together along side seams 18 and 20, respectively, and front and back seams 22 and 24 to form side sections having a front portion and a back portion.

As illustrated in FIGS. 2 and 3 the stitching of the two side sections in front provides the seam 22 that extends from the waist level 26 down to approximately a point 28, and, in back the seam 24 that extends from the waist level 26 down to approximately 30. This forms the upper part of the trunk 8 having a waist opening 44.

Below the points 28 and 30 the free edges of each side section are independently stitched together along seams 23 and 25, respectively, to provide leg openings 40 and a crotch opening 36 between the two side sections. The edges of the leg openings 40 and the waist opening 44 are hemmed and zig-zag stitched flat at 42 and 46. The hem of the waist opening 44 is also faced with a soft stretchable band 48 which covers the inside face and edge thereof.

An underlay panel 32 spans the front seam 22 and is stitched flat marginally thereto along the line 34 for tummy form control.

Figure 4:
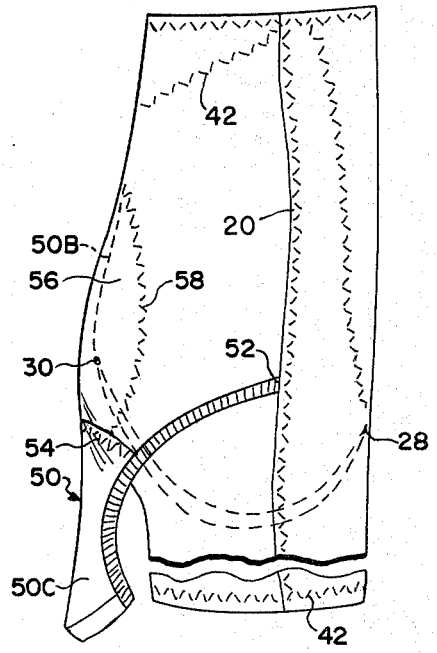
FIG. 4 is a side perspective view of a high top girdle similar to the girdle and condition shown in FIG. 2.

A two-way stretch panel 50 has a back portion 50B which, as illustrated in FIGS. 3 and 4, is secured to the trunk at the waist level 26 as a portion of the hem 46 across the back. These side edges are folded and zigzag stitched in the side seams 18 and 20 down to approximately 52 where the lower edges converge towards each other and arcuately curve to form a crotch flap 50C which when stretched and secured in place preferably follows marginally the skin fold lines that border the crotch where it can be supported on the pubis bone of the wearer and terminate at approximately the pubic crest or arch thereof.

Preferably, for better form fitting, the narrowed end crotch flap 50C comprises a separate piece cut along a curve 54 that centrally arches into and is secured by stitches 55 to the back portion 50B and also engages the lower end of an underlay 56. This underlay has laterally curved sides 58 zig-zag stitched to the panel back portion 50B and ends at the top well below the waistline. The underlay 56 increases resistance to stretch over its area thereby enabling the sides of the panel 50B to be drawn more tightly laterally and the whole panel stretched downwardly from the waist level 26 appreciably to round the fanny and hips of the wearer and also permit easy bodily movement of the crotch portion downwardly nd forwardly over the crotch opening 36 when stretched, and then retract the crotch flap 50C rearwardly and upwardly at the back when unstretched. Essentially the overlay provides firm support across the fanny and a decreased length thereof determines the resulting degree of mild tension placed upon the fastened crotch flap for co-movement with the skin contacted as distinguished from slipping and chafing.

The free end of the crotch flap 50C terminates in a widened end portion 60V identified as V-shaped in FIG. 2 or straight across 60S identified in FIG. 7. The V-shape of FIG. 2 is preferred since the ends of the V can be separated as widely as desired after the point thereof has been attached. Preferably, the securement is provided for uniform spread of contact tension, easy fastening and loosening, and a variable degree of lateral stretching that is permitted in fastenings of this type. The securement is preferably of the type known as a VELCRO fastener of the type described in U.S. Pat. No. 2,717,437 wherein raised piles of thread on two woven strips sewn to the members interlock when pressed together, one pile 62 operating as minute hooks that interlock with loops on the other pile 64. Preferably, the pile 62 upon the trunk defines a larger area for this purpose.

Thus, with a mild tension that varies very little with localized movement within the length of the panel, there is very little, if any irritation to a woman's skin in her normal activities since the skin and material can move together without providing any relative movement or strain between them. Yet, the crotch flap 50C when released will retract easily nd completely and is recovered and and under ultimate sanitary conditions.

The panel 50 which permits a two-way stretch from the waist level 26 at the rear and from between the side seams 18 and 20 towards the crotch not only substantially eliminates frictional skin irritation but provides an excellent fanny overlay for foundation smoothness and opaqueness for tight form fitting outer garments with maximum comfort.

The material of which the crotch panel 50 is made is of stretchable relatively soft, non-irritating material which engages the body without undue strain or chafing to compensate for strain involved with the continual changing positions of the wearer's body.

The two way stretch material employed in the girdle is a Kidde net identified as Spandex made by duPont, preferably having a denier of 280 with a 130% stretch. Heavier denier may be used where large size girdles are made.

What is claimed is:

1. A girdle comprising:

a trunk of two-way stretch material having side seams and defining a waist opening and a lower portion defining leg openings; said trunk defining an elongated crotch opening disposed between the leg openings;

a two-way stretch panel for closing said crotch opening having a back portion attached at one end to the rear part of the trunk at the waist level thereof and a substantial distance along the side seams thereof above the level of the crotch opening, said panel narrowing therebelow to a crotch flap having a free end clearing the crotch opening when unstretched; and fastening means provided upon said free end and upon the trunk at approximately the pubic crest of a wearer thereof for releasably holding the crotch flap under the tension established throughout the stretch panel when the free end of the crotch flap is drawn down and forward between the leg receiving openings and is fastened to the trunk.

2. The girdle defined in claim 1 in which the stretch tension in the back portion exerted upon the crotch flap is spread to and carried by trunk at the waist level and the side seams of the stretch panel for retracting the crotch flap rearwardly and upwardly at the back when unstretched upon opening the crotch opening.

3. The girdle defined in claim 1 in which said stretch panel back portion includes an underlay confined to the central area of said back portion and terminates at the crotch opening in connection with the rear end of the crotch flap to distribute stretch effort of the crotch flap to the back portion around said underlay.

4. The girdle defined in claim 1 in which said fastening means includes matable Velcro-type fastening strips arranged in an inverted V-shape, one on the free end of the crotch flap and the other at approximately the pelvic crest.

5. The girdle defined in claim 1 in which the two-way stretch material is made of Spandex having a denier of approximately 280 with a 130% stretch.

* * * * *